US006540484B1

(12) United States Patent
Hugenroth et al.

(10) Patent No.: US 6,540,484 B1
(45) Date of Patent: Apr. 1, 2003

(54) SCROLL COMPRESSOR WITH THERMOSTAT MOUNTED IN NON-ORBITING SCROLL

(75) Inventors: Jason Hugenroth, Hope, AR (US); James E. Barnes, Arkadelphia, AR (US)

(73) Assignee: Scroll Technologies, Arkadelphia, AR (US)

( * ) Notice: Subject to any disclaimer, the term of this patent is extended or adjusted under 35 U.S.C. 154(b) by 0 days.

(21) Appl. No.: 10/001,291

(22) Filed: Nov. 1, 2001

(51) Int. Cl.[7] ..... F04B 49/10; F04B 49/00; F04B 49/06; F04B 17/00

(52) U.S. Cl. ..... 417/32; 417/18; 417/44.1; 417/292; 417/410.5

(58) Field of Search ..... 417/18, 32, 44.1, 417/292, 410.5; 418/55.1

(56) References Cited

U.S. PATENT DOCUMENTS 5,200,872 A * 4/1993 D'Entremont et al. ..... 361/25
5,368,446 A * 11/1994 Rode ..... 417/18
5,452,989 A * 9/1995 Rood et al. ..... 417/29
5,509,786 A * 4/1996 Mizutani et al. ..... 417/32

* cited by examiner

*Primary Examiner*—Charles G. Freay
*Assistant Examiner*—Timothy P. Solak
(74) *Attorney, Agent, or Firm*—Carlson, Gaskey & Olds

(57) ABSTRACT

A thermostat is positioned within a scroll compressor such that a thermostat switch is positioned in the non-orbiting scroll, and a body of the thermostat extends through the crankcase. The thermostat communicates with a heater associated with a motor protector circuit. Current is directed to the heater causing the heater to more promptly stop operation of the scroll compressor. A bias element holds the thermostat securely within the crankcase and non-orbiting scroll such that it will not rattle during operation. Several embodiments of the thermostat are disclosed.

12 Claims, 8 Drawing Sheets

SCROLL COMPRESSOR WITH THERMOSTAT MOUNTED IN NON-ORBITING SCROLL

BACKGROUND OF THE INVENTION

This invention relates to the unique placement of a thermostat associated with a protection circuit for a scroll compressor motor.

Scroll compressors are becoming widely utilized in refrigerant compression applications. In a scroll compressor, a first scroll member orbits relative to a second scroll member. Each of the scroll members has a base with a generally spiral wrap extending from its base. The wraps interfit to define compression chambers which are reduced in volume as the two orbit relative to each other.

There are many challenges in the design of scroll compressors. One major challenge relates to a loss of charge in the refrigerant system associated with refrigerant compression. In a loss of charge situation, the amount of refrigerant circulating within the refrigerant cycle is reduced, such as by a leak. Under such conditions, continued operation of the refrigerant cycle is undesirable. Other problems in the system can result in increased temperatures within the compressor. One such problem is so-called reverse-rotation, which can occur such as when the motor is improperly wired and runs in a reverse direction.

Motors for compressors in refrigerant cycles, and in particular for scroll compressors are typically provided with a protector circuit. A motor protector circuit includes a switch which opens should a temperature associated with the compressor exceed a predetermined maximum. Thus, should the operating temperature within the compressor exceed the expected normal temperature range, the switch will open. When the switch is open, the motor is stopped, thus stopping operation of the compressor. Recently, systems have been developed wherein a thermostat is associated with a location remote from the motor, and positioned closer to the scroll members. The thermostat is operable to close when a predetermined temperature is reached. When the thermostat closes, current flows to a heater which is positioned near the motor protector switch. This increases the heat at the motor protector switch, and will result in the switch opening potentially at an earlier point than if the thermostat did not add further current to the heater. That is, by positioning the thermostat adjacent to scroll members, the changes in temperature will be more promptly sensed, and the system will be more quickly responsive to undesirable conditions.

The present invention is directed to an improved and preferred placement of the thermostat adjacent the scroll members.

SUMMARY OF THE INVENTION

In the disclosed embodiment of this invention, the thermostat has a body mounted partially within a crankcase which supports the orbiting scroll. The thermostat body extends to the thermostat switch itself, which extends into a cavity in the non-orbiting scroll. Preferably, a bias member holds the thermostat body at a position such that it is not subject to rattling. In one preferred embodiment, a cavity is formed within a crankcase tower to receive the thermostat body. The thermostat switch itself is formed in a cap at an upper end of the body. The cap extends into a cavity within the non-orbiting scroll.

The bias member may extends forwardly from the body and abutt an opening in the crankcase in one embodiment.

In a second embodiment the bias member is formed between the thermostat switch itself and the cavity in the non-orbiting scroll.

The thermostat may be a single piece, or could include a two-part plug in connection between the switch generally received in the non-orbiting scroll, and an elongate body section received within the crankcase tower. dr These and other features of the present invention can be best understood from the following specification and drawings, the following of which is a brief description.

DETAILED DESCRIPTION OF THE PREFERRED EMBODIMENT

Figure 1:
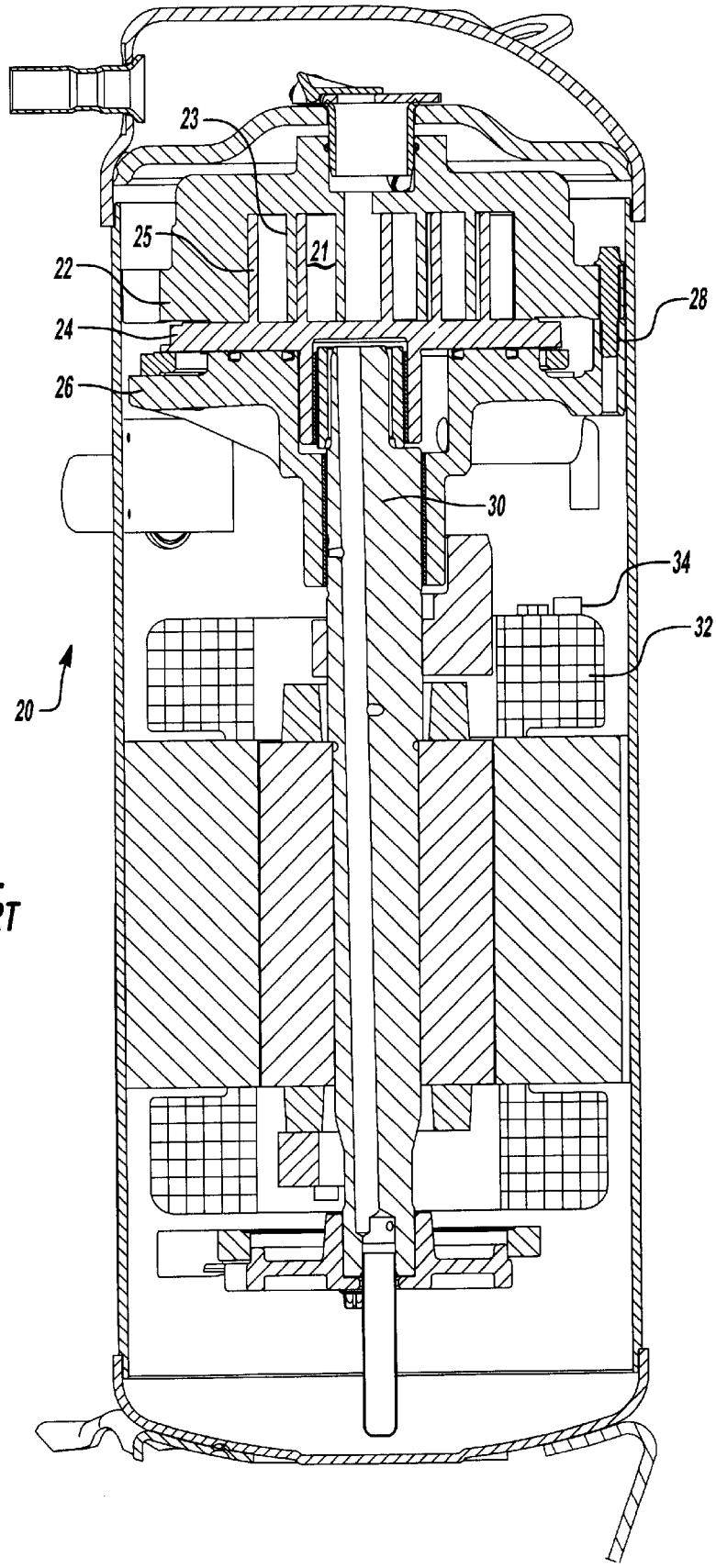
Fig-1 PRIOR ART
FIG. 1 is a view of a prior art scroll compressor.

FIG. 1 shows a prior art scroll compressor 20. As is known, a non-orbiting scroll 22 includes a wrap 23 which defines compression chambers 21 in combination with the wraps 25 from an orbiting scroll 24. A crankcase 26 supports the orbiting scroll 24. As known, the crankcase 26 includes a plurality of towers 28 which are spaced circumferentially about the crankcase 26. A shaft 30 is driven by an electric motor 32 to cause the orbiting scroll 24 to orbit through a connection such as is known.

A motor protector circuit 34 is associated with the motor. This circuit preferably is operable to sense changes in temperature, and stop operation of the motor 32. Several embodiments are disclosed in co-pending U.S. patent application Ser. No. 09/576,571 entitled "Sealed Compressor with Temperature Feedback to Motor Protector Unit". Essentially, a thermostat is associated with the scroll members and closes when a particular temperature is reached. When the thermostat closes it directs current through a heater which is part of the motor protector circuit 34. The heater may be positioned adjacent but outside the protector switch, or within the protector switch. When the heater receives increased current, the switch within protector switch 34 opens to stop operation of the motor.

Figure 2A:
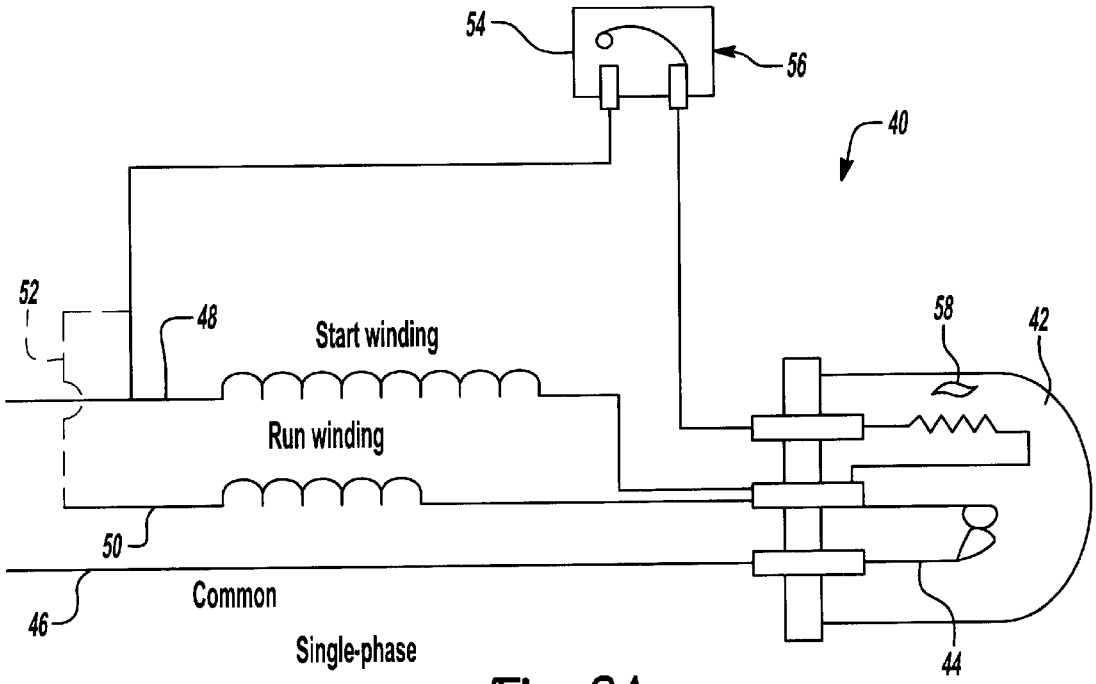
FIG. 2A is a schematic view of a single phase motor protector circuit.

FIG. 2A shows a first embodiment circuit for the motor protector switch for a motor protector circuit 40. As shown, a protector switch body 42 includes a switch 44 which is selectively opened. As known, a common line 46 communicates with a start winding 48 and a run winding 50. In this embodiment, the start winding 48 is shown connected to a thermostat 54 having a switch 56. The thermostat 54 is positioned adjacent the pump unit, which comprises the two scroll members. As will be shown, most preferably, this thermostat 54 is positioned within both the crankcase and the non-orbiting scroll. The thermostat switch 56 when opened does not direct current to a heater 58. However, when closed, current does pass to the heater 58. This additional heat will cause the switch 44 to open more promptly than if the additional heater 58 was not actuated. As known, but not shown in the figure, other heaters are typically associated with the start winding and the run winding.

As shown in FIG. 2A, a jumper 52 could be provided between the run winding to supply power to the thermostat 54 in an alternative embodiment. That is, the run winding could power the thermostat 54 rather than the start winding 48.

Figure 2B:
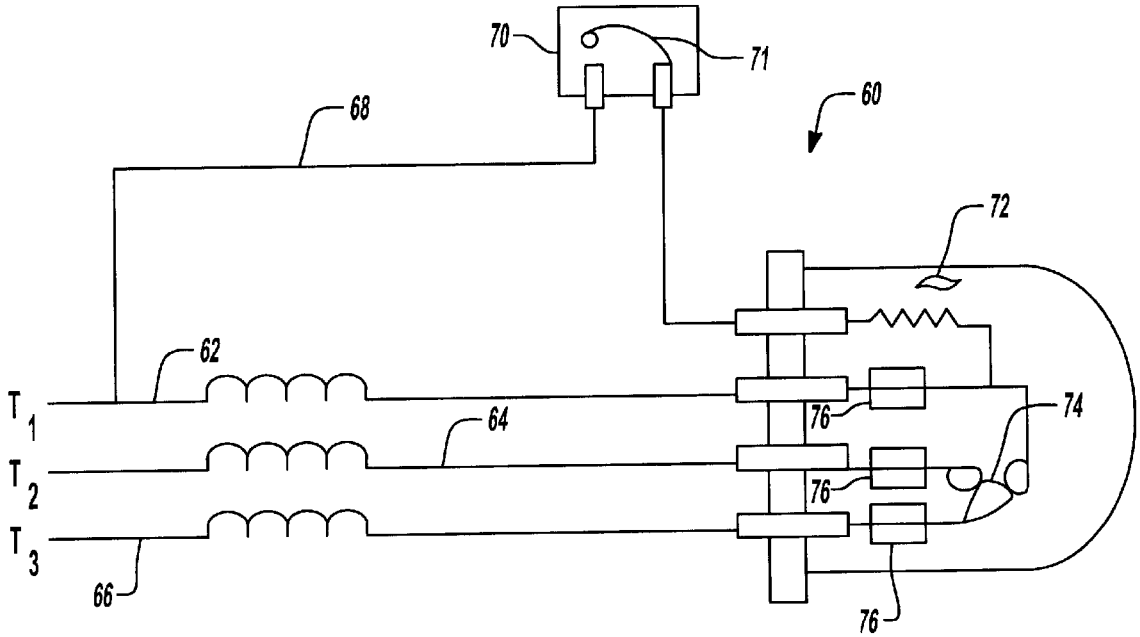
FIG. 2B is a schematic of a three-phase motor protector circuit.

FIG. 2B shows another circuit 60 utilized with a three-phase motor. As is known, three power lines 62, 64, and 66 selectively drive the motor. A tap 68 delivers current to the thermostat 70. The thermostat 70 operates as the thermostat 54 and includes a switch 71 which selectively closes. A protector switch body 72 includes a switch 74 which will selectively open to stop operation of the compressor motor. As known, each line 62, 64 and 66 may be provided with its own heater 76, shown schematically. As with the prior embodiment, the use of the additional auxiliary heater 72 powered by the thermostat 70 will provide more prompt opening of the switch 74 since it is powered by an element more proximate to the compressor pump unit wherein the heat is initially likely to generate.

Figure 3:
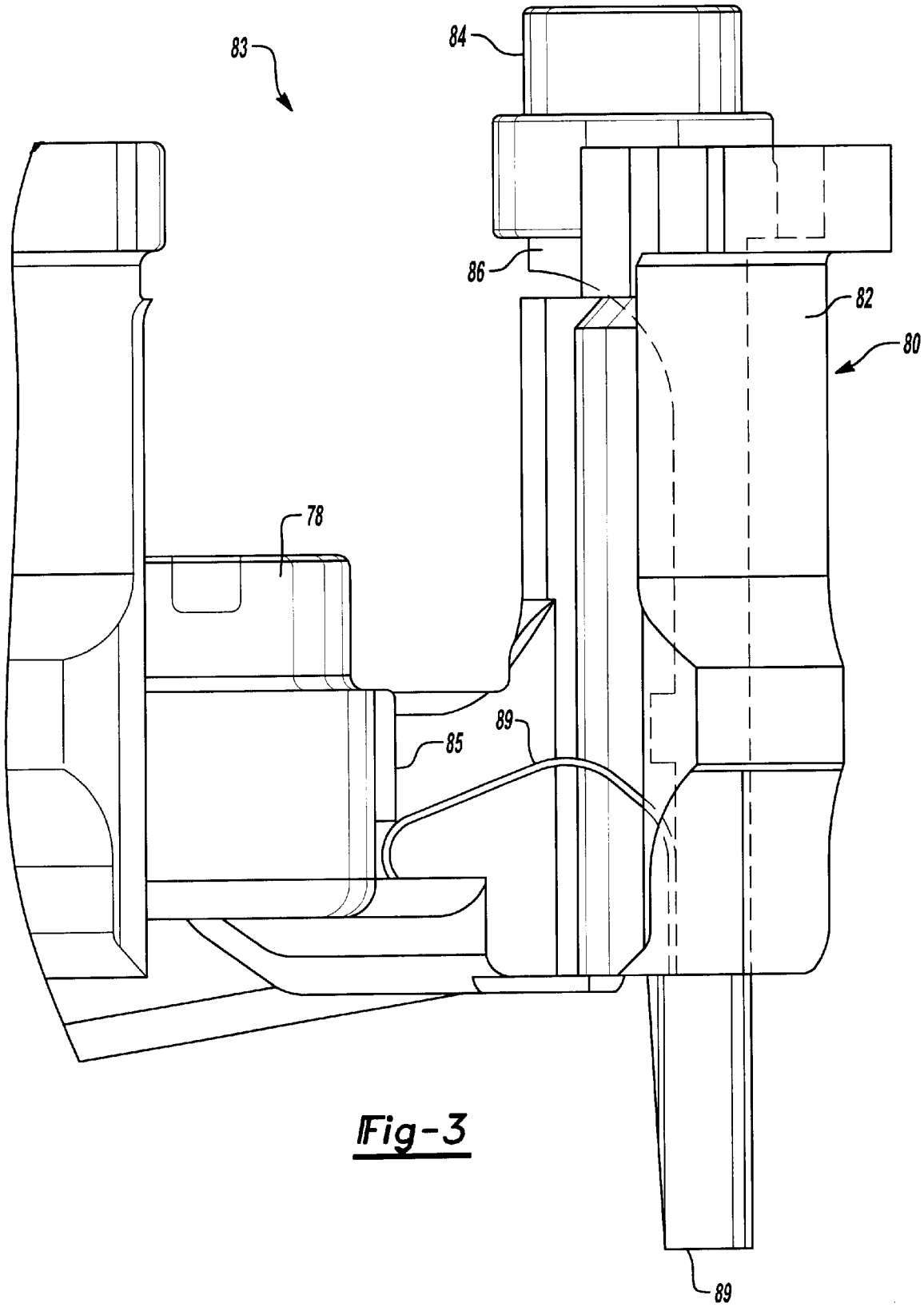
FIG. 3 shows a first embodiment of the thermostat of this invention.

FIG. 3 shows an embodiment 80 of this invention. In this embodiment, the crankcase 78 includes towers 82, which are generally as known. A thermostat 83 includes a thermostat switch portion 84 at an upper end and an elongate body portion 86. An inner opening 85 in the crankcase provides a bias surface for a spring 87. The spring 87 holds the body 86 at a position within the tower 80, and prevents rattling, etc. As is shown schematically, power lines 89 run from the thermostat body 86 such that the thermostat may be wired generally shown in FIG. 2A or 2B.

Figure 4A:
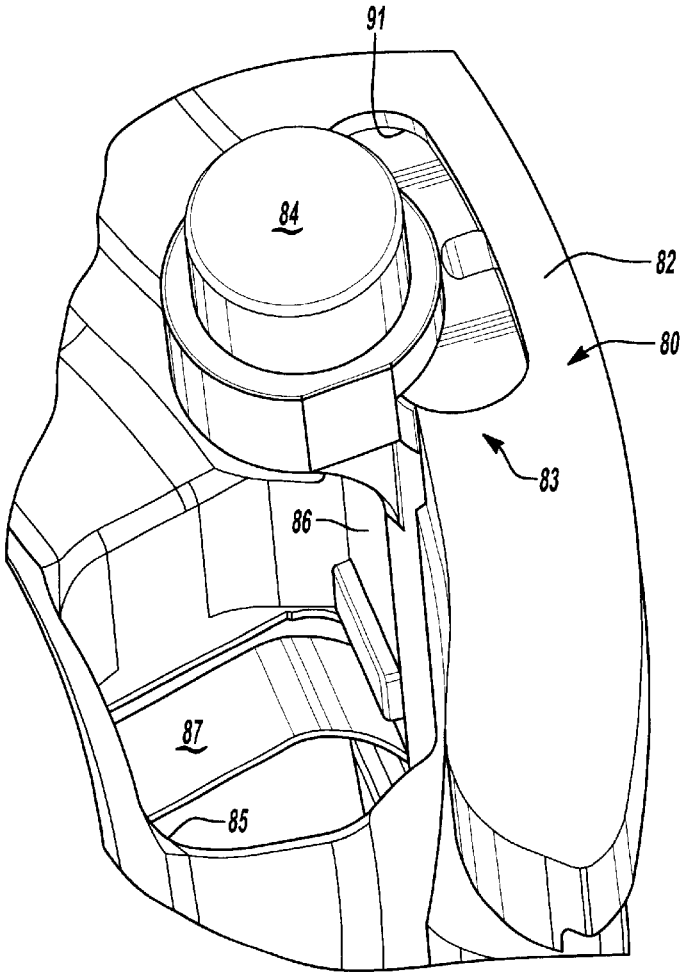
FIG. 4A is a top view of the FIG. 3 embodiment.
Figure 5:
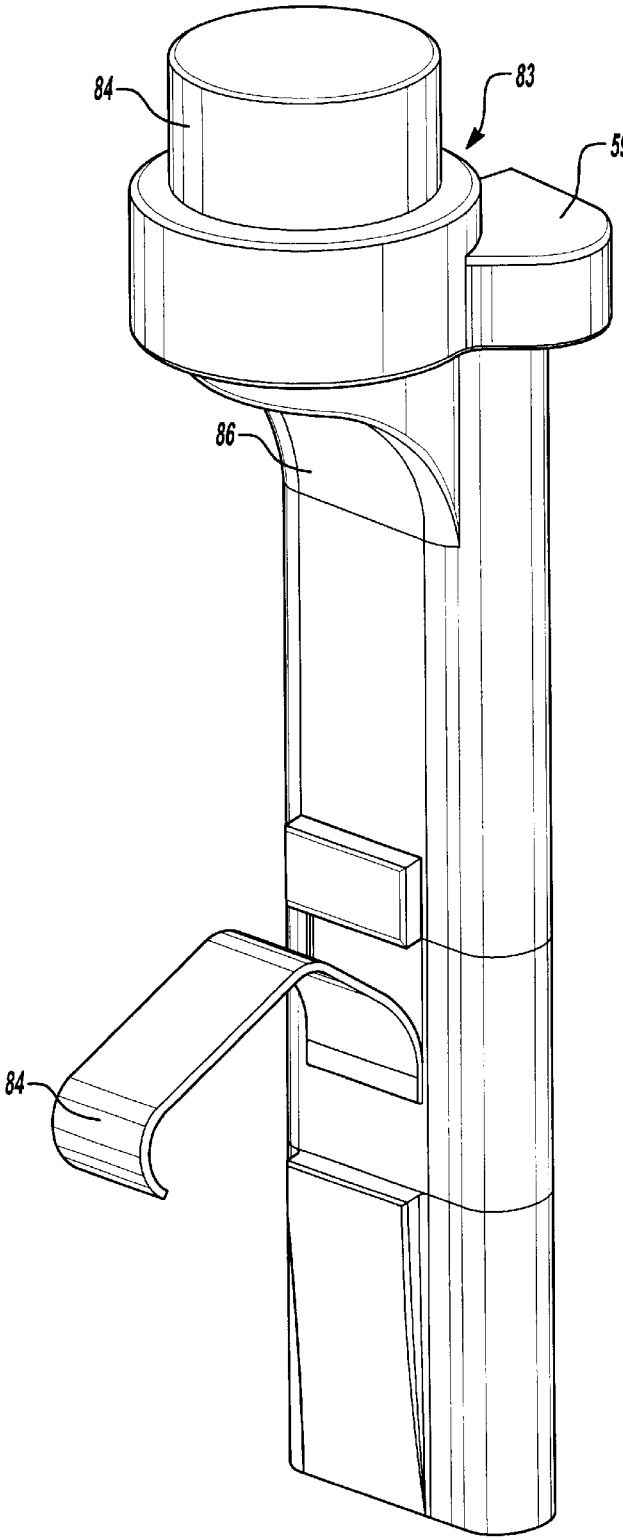
FIG. 5 is a perspective view of the FIG. 3 thermostat.

As shown in FIG. 4A, the tower 82 includes an upper cavity 91 receiving the body portion 86 of the thermostat 83. As can be appreciated from FIG. 5, a wing portion 59 on thermostat body 86 will extend into the opening 91.

Figure 4B:
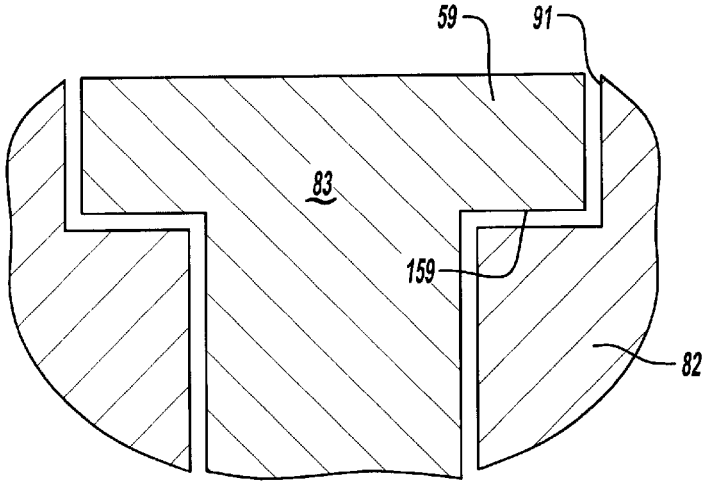
FIG. 4B shows a ledge that supports a portion of the thermostat.

As shown in FIG. 4B, the thermostat 83 ears 59 rest on surfaces 159 of the tower 82 and as part of the opening 91. Thus, the thermostat 83 is supported within the tower 82.

Figure 6A:
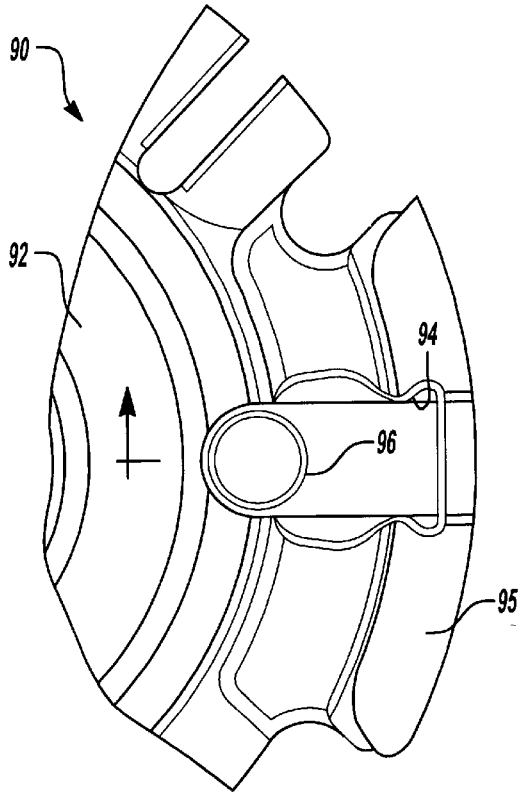
FIG. 6A is a view of a second embodiment.

FIG. 6A shows another embodiment 90 wherein the crankcase 92 has a cavity 94 within a tower 95. The thermostat 96 is received within the cavity 94.

Figure 6B:
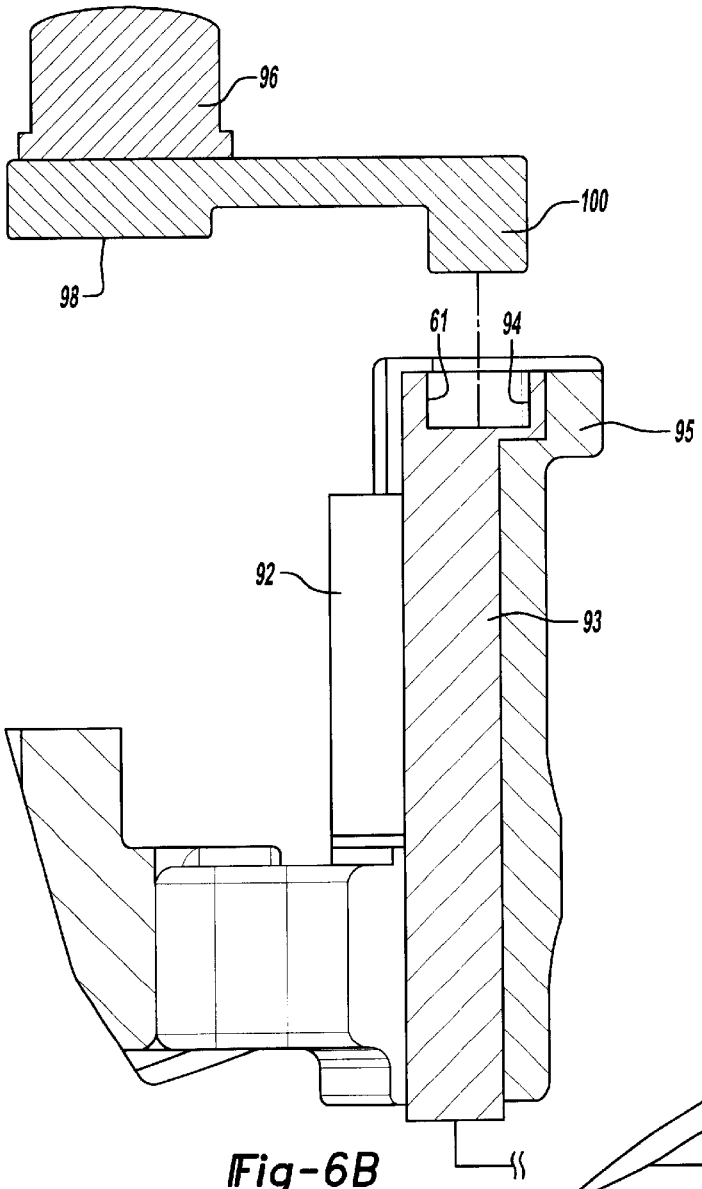
FIG. 6B is an exploded view of the FIG. 6A embodiment.

As shown in FIG. 6B, the thermostat switch 96 includes a lower end 98 and a plug-in portion 100. Plug-in portion 100 plugs into a plug section 61 of a lower thermostat body 93.

Figure 6C:
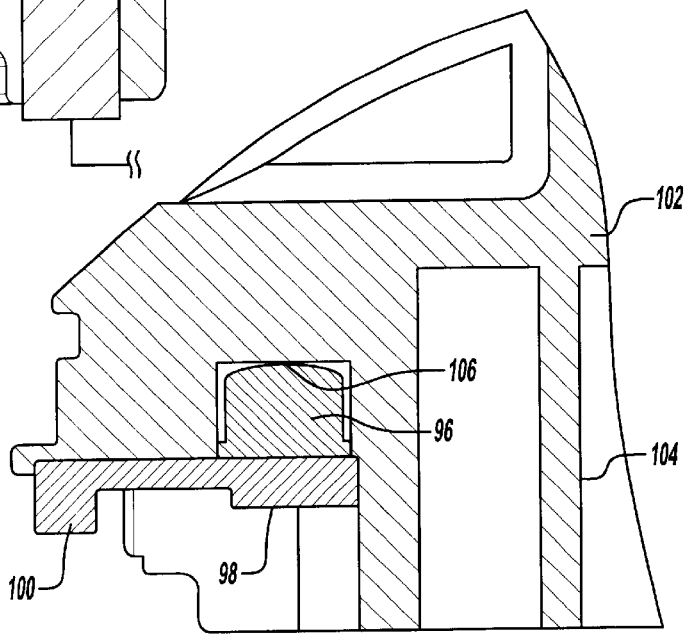
FIG. 6C shows a mounted portion of the FIG. 6A embodiment.

As shown in FIG. 6C, the non-orbiting scroll 102 has wraps 104. The switch portion 96 extends upwardly to be within the axial extent of the wrap 104. That is, the switch 96 will be within an axial length defined along the driveshaft which is associated with the compression chambers. In this way, heat will be transmitted directly and quickly to the switch portion 96 from the wraps. The non-orbiting scroll 102 includes the cavity 106 to receive the switch 96.

Figure 6D:
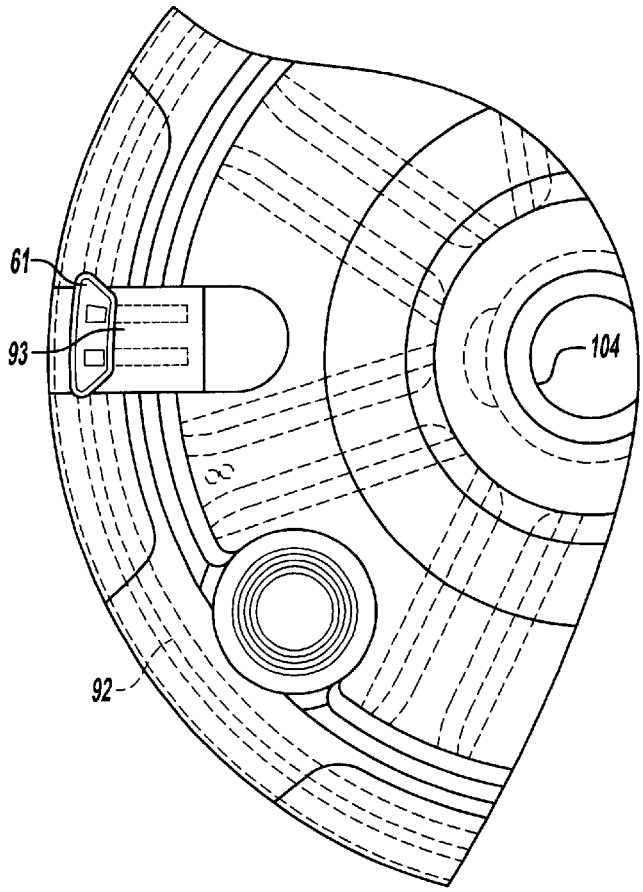
FIG. 6D shows another view of the FIG. 6A embodiment.

As shown in FIG. 6D, the lower body 93 includes the plug section 61 and is positioned within the crankcase 92.

Figure 6E:
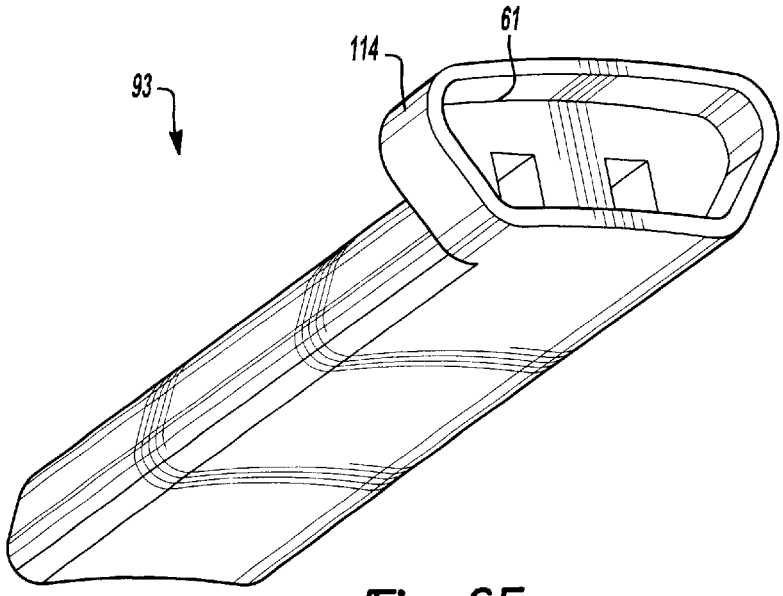
FIG. 6E is a perspective view of one portion of the FIG. 6A embodiment.

FIG. 6E shows the body 93 including its plug section 61. Ears 114 support the body on the crankcase.

Figure 7A:
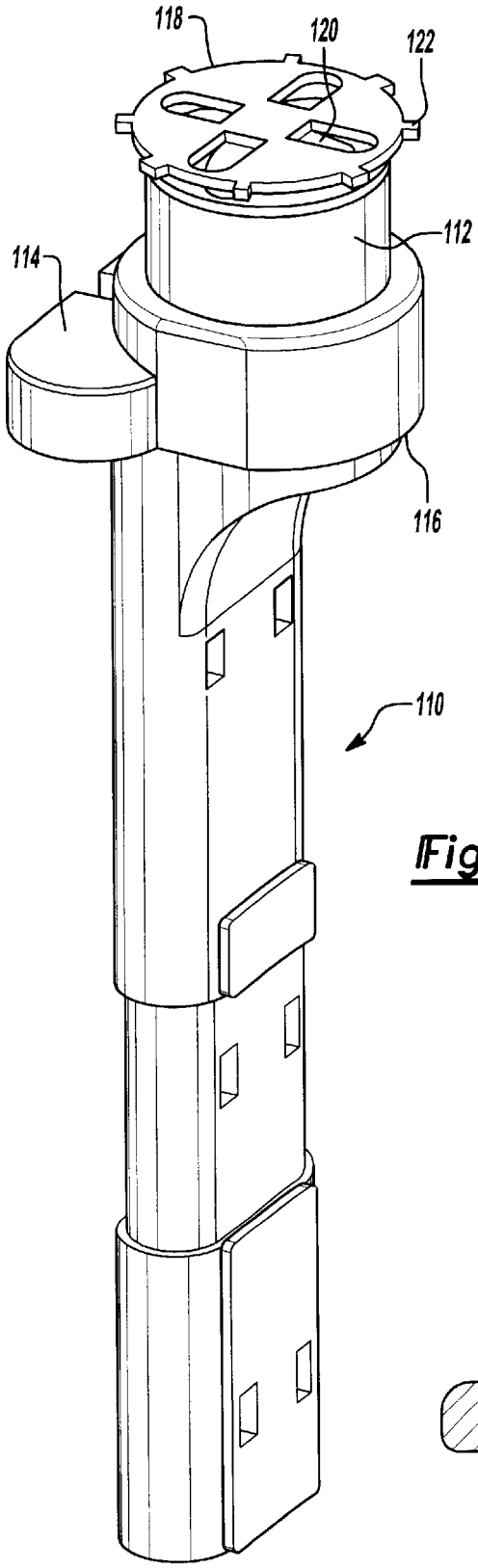
FIG. 7A shows another embodiment.

FIG. 7A shows an alternative thermostat 110 having its switch portion 112 and outer ears 114. The body 116 no longer carries a bias element. Instead, as is shown at 118, a spring member is placed on the switch 112. A plurality of spring fingers 120 are bent downwardly to abut the upper surface of the switch 112. Further, tangs 122 extend outwardly.

Figure 7B:
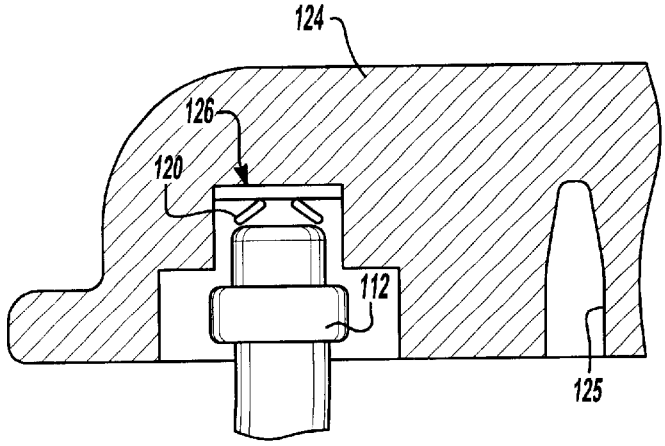
FIG. 7B shows another view of the FIG. 7A embodiment.

As shown in FIG. 7B, the tangs 120 hold the upper end of the switch 112. A cavity 126 within a non-orbiting scroll 124 receives the tangs 122 such that the spring is held within the cavity 126. The fingers 120 in turn hold the upper end of the switch 112. As can also be seen in this figure, the location of the switch is again within the axial length of the scroll wrap 125.

Although the FIGS. 7A and 7B spring is illustrated with a one-piece thermostat, it can also be utilized with the thermostat embodiment of FIGS. 6A–6E.

In sum, this application relates to the unique positioning of a thermostat body in a scroll compressor. The thermostat is securely held and its position is optimized.

Although the thermostat switch is shown in the schematics as closing when the predetermined temperature is reached, with simple reworking of the circuit, a circuit can be provided which increases current flow to a heater when the switch is opened. This application extends to cover any such modification of the basic invention.

Although preferred embodiments of this invention have been disclosed, a worker of ordinary skill in this art would recognize that certain modifications would come within the scope of this invention. For that reason, the following claims should be studied to determine the true scope and content of this invention.

What is claimed is:

1. A scroll compressor comprising:

a first scroll member having a wrap and a generally spiral wrap extending from its wrap;

a second scroll member having a base and a generally spiral wrap extending from its base;

a crankcase for supporting said second scroll member;

a shaft for causing said second scroll member to orbit relative to said first scroll member, and an electric motor for causing said shaft to rotate; and a protector switch associated with said motor, said protector switch including a switch which selectively opens to stop operation of said motor, and a thermostat positioned in cavities in said crankcase and said first scroll member, said thermostat being actuated when a predetermined temperature is sensed and direct additional current to a heater associated with said switch.

2. A scroll compressor as recited in claim 1, wherein said thermostat includes an elongate body and a thermostat switch, said thermostat switch being positioned in a cavity in said first scroll member.

3. A scroll compressor as recited in claim 2, wherein a bias element holds said thermostat relative to said crankcase and said first scroll member.

4. A scroll compressor as recited in claim 3, wherein said bias element is positioned in a cavity in said first scroll member.

5. A scroll compressor as recited in claim 4, wherein said bias element includes a plurality of spring fingers bent downwardly against an upper end of said thermostat switch.

6. A scroll compressor as recited in claim 5, wherein said bias element further includes a plurality of tang fingers holding said bias element within said cavity in said first scroll member.

7. A scroll compressor as recited in claim 3, wherein said bias element is a spring finger extending from said body of said thermostat and abutting a surface on said crankcase.

8. A scroll compressor as recited in claim 7, wherein said bias element extends at an angle to abut an inner surface of an opening through said crankcase which receives said thermostat body.

9. A scroll compressor as recited in claim 2, wherein said thermostat switch is a separate part from a body of said thermostat.

10. A scroll compressor as recited in claim 9, wherein said thermostat switch is received within a cavity in said non-orbiting scroll and has electrical connections which plug into said thermostat body.

11. A scroll compressor as recited in claim 1, wherein said crankcase includes at least one tower extending forwardly from said crankcase, said at least one tower including said cavity and said thermostat being received within said tower.

12. A scroll compressor comprising:

a first scroll member having a wrap and a generally spiral wrap extending from its wrap;

a second scroll member having a base and a generally spiral wrap extending from its base;

a crankcase for supporting said second scroll member, said crankcase having at least one tower;

a shaft for causing said second scroll member to orbit relative to said first scroll member, and an electric motor for causing said shaft to rotate;

a protector switch associated with said motor, said protector switch including a switch which selectively opens to stop operation of said motor, and a thermostat positioned in a cavity in said tower and a cavity in said first scroll member, said thermostat being operable to close when a predetermined temperature is sensed and direct additional current to a heater associated with said switch, and a bias element to hold said thermostat.

* * * * *